US007918631B2

(12) United States Patent
Overbye

(10) Patent No.: US 7,918,631 B2
(45) Date of Patent: Apr. 5, 2011

(54) MODULAR VEHICLE TRANSPORT

(75) Inventor: Harold L. Overbye, Lakeville, MN (US)

(73) Assignee: OverRide Decking Systems Limited Liability Limited Partnership, Lakeville, MN (US)

( * ) Notice: Subject to any disclaimer, the term of this patent is extended or adjusted under 35 U.S.C. 154(b) by 491 days.

(21) Appl. No.: 11/971,719

(22) Filed: Jan. 9, 2008

(65) Prior Publication Data

US 2009/0175698 A1 Jul. 9, 2009

(51) Int. Cl.
*B60P 7/08* (2006.01)

(52) U.S. Cl. ..... 410/4; 410/24; 410/26; 410/67; 410/89

(58) Field of Classification Search ..... 410/2, 3, 410/4, 7, 13, 16, 24, 25, 26, 27, 30, 67, 89, 410/129; 211/85.7, 85.8; 414/462, 498, 414/537; 224/403–405; 296/3
See application file for complete search history.

(56) References Cited

U.S. PATENT DOCUMENTS 6,524,055 B1 2/2003 Overbye
7,455,489 B1 * 11/2008 Klev et al. ..... 410/4

* cited by examiner

*Primary Examiner* — Stephen Gordon
(74) *Attorney, Agent, or Firm* — Thomas J. Nikolai; Nikolai & Mersereau, P.A.

(57) ABSTRACT

In some embodiments, a decking system may include one or more of the following features: (a) a plurality of deck panels operably coupled to and supported by rails extending parallel to the deck panels, (b) a plurality of rail legs coupled to the rails at one end of the rail leg and extending the rails up off of a base coupled to the rail leg at a second end of the rail leg, (c) a plurality of cross rails positioned perpendicular to the deck panels and rails, the cross rails coupled to the rails and supporting angle bars welded to the deck panels, (d) a plurality of angled support members coupled to the base and to the rail legs, (e) a floor coupler attached to the rail leg for providing attachment to the base, (f) a decking coupler attached to the rail leg for providing attachment to the rail, and (g) a ladder slat coupled to the rail having slots to receive cross rails.

15 Claims, 5 Drawing Sheets

MODULAR VEHICLE TRANSPORT

FIELD OF THE INVENTION

Embodiments of the present invention generally relate to transport systems. Particularly, embodiments of the present invention relate to facilitating transport of vehicles. More particularly, embodiments of the present invention relate to decking systems used for shipping vehicles in freight containers of all types.

BACKGROUND

Shipping is the physical process of transporting goods and cargo. Virtually every product ever made, bought, or sold has been affected by shipping. Despite the many variables in shipped products and locations, there are only three basic types of shipments: land, air, and sea.

Land or ground shipping can be either by train or by truck. Trucking is easily the most popular form of shipping. Even with air and sea shipments, ground transportation is still required to take the product from its origin to the airport or seaport and then to its destination. Ground transportation is typically more affordable than air shipments, but more expensive than shipping by sea. Trucks are also much faster than ships and rail but slower than planes. Many trucks will take freight directly from the shipper to its destination in what is known as a door to door shipment. Vans and trucks of all sizes make deliveries to sea ports and air ports where freight is moved in bulk also.

Manufacturers of vehicles, such as ATVs and golf carts, need a way to economically ship finished units from their factories to distributors and dealers throughout the country and oversees. Shipping these vehicles throughout the country can be done with semi-trailers. A semi-trailer is a trailer without a front axle. A large proportion of its weight is supported either by a road tractor or by a detachable front axle assembly known as a dolly or by the tail of another trailer. A semi-trailer is normally equipped with legs which can be lowered to support it when it is uncoupled. A road tractor coupled to a semi-trailer is often called a semi-trailer truck or semi. Though most road trailers meet this definition, the term is most often applied to heavy trailers appropriate for use in such a rig.

A typical trailer for an 18-wheel semi-tractor trailer is 8 ft. 6 in. wide, 53 ft. long and from floor to ceiling is about 9 ft. 2 in. in height. In shipping ATVs without crating, they can be placed two abreast in a semi-trailer and, given the length of the ATVs, however, only a limited number can be loaded onto the floor of the semi-trailer. If ATVs could be stacked two high within the semi-trailer, the hauling capacity can be doubled.

While it is recognized a semi-trailer could be especially constructed with an intermediate deck between the floor and ceiling of the semi-trailer, this application would be limited to being used on box trailers and not to curtain siders (a curtain sider is similar to a box trailer except the sides are movable curtains made of reinforced fabric coated with a waterproof coating). Thus only half of a curtain side semi-trailer can be used when transporting vehicles. Further, intermodal freight containers have no catch mechanisms mounted to the side of the containers for mounting an intermediate deck between the floor and the ceiling.

When shipping vehicles such as ATVs and golf carts, the vehicles are often crated up and placed in containers made of wood. However, the utilization of crates becomes problematic when shipping vehicles overseas. Due to the International Plant Protection Convention (abbreviated IPPC), most crates shipped across national borders must be made of materials are incapable of being a carrier of invasive species of insects and plant diseases. The standards for these pallets are specified in ISPM 15.

Crates made of raw, untreated wood are not compliant with ISPM 15. To be compliant the crates must be treated by either of the following under the supervision of an approved agency. (1) Heat treatment: The wood must be heated to achieve a minimum core temperature of 56° C. for at least 30 minutes. Crates treated via this method bear the initials HT near the IPPC logo. (2) Chemical fumigation: The wood must be fumigated with methyl bromide. Crates treated via this method bear the initials MB near the IPPC logo. Making creates IPPC compliant can be very expensive and purchasing these crates to ship commodities can be very expensive. Crates made of non-wood materials such as steel, aluminum, plastic, or engineered wood products, such as plywood, oriented strand board, or cardboard do not need IPPC approval. However, these crates are equally expensive.

Further, crates can take up a lot of space in the container used to ship commodities overseas. Containerization is a system of intermodal freight transport using standard ISO containers (known as shipping containers or isotainers) loaded and sealed intact onto container ships, railroad cars, planes, and trucks. Containers have similar dimensions to the tractor trailer discussed above.

It would be desirable to provide a decking system readily installed and taken down by a single workman and which is relatively compact, allowing storage at the front of a trailer or container when not in use. It would be further desirable to eliminate the need for crates to ship vehicles such as ATVs and golf carts. It would be desirable to reduce the cost of shipping vehicles such as ATVs and golf carts. It would be desirable to eliminate the need to comply with regulations surrounding the use of crates in shipping materials.

SUMMARY OF THE INVENTION

In some embodiments, a decking system may include one or more of the following features: (a) a plurality of deck panels operably coupled to and supported by rails extending parallel to the deck panels, (b) a plurality of rail legs coupled to the rails at one end of the rail leg and extending the rails up off of a base coupled to the rail leg at a second end of the rail leg, (c) a plurality of cross rails positioned perpendicular to the deck panels and rails, the cross rails coupled to the rails and supporting angle bars welded to the deck panels, (d) a plurality of angled support members coupled to the base and to the rail legs, (e) a floor coupler attached to the rail leg for providing attachment to the base, (f) a decking coupler attached to the rail leg for providing attachment to the rail, and (g) a ladder slat coupled to the rail having slots to receive cross rails.

In some embodiments, a decking system for vehicles may include one or more of the following features: (a) a rail leg having a floor coupler and a decking coupler; the floor coupler capable of being coupled to a base of a shipping container, (b) a rail coupled to the decking coupler, (c) a first cross rail coupled to the rail, the cross rail being perpendicular to the rail, (d) a deck panel supported by the first cross rail and a second cross rail coupled to the rail, (e) angle bars welded to the deck panel, the angle bars being supported by the first cross rail and the second cross rail, and (f) a third cross rail extending between the rail and a second rail approximately half way down the deck panel to be received by a channel in the deck panel.

In some embodiments, a decking system for shipping ATVs may include one or more of the following features: (a) a left deck panel, a center deck panel, and a right deck panel, (b) a first cross rail supporting a front of the left, the center, and the right deck panels, (c) a second cross rail supporting a middle of the left, the center, and the right deck panels, (d) a third cross rail supporting a rear of the left, the center, and the right deck panels, (e) a first rail coupled to a left end of the first, the second, and the third cross rail, (f) a second rail coupled to a right end of the first, the second, and the third cross rail, (g) a rail leg coupled to a front, middle and rear of the first and second rails, (h) angle bars welded to the deck panels, the angle bars resting upon the first and third cross rails for the deck panels support, (i) a channel located in a midportion of the deck panels for accepting the second rail within the channel, (j) a ladder slat within a slat slot on the rails, (k) a claw catch located on the right and the left ends or the cross rails for insertion into a slot on the ladder slat, and (l) a rail slot on the rails for coupling the rails to the rail legs.

DESCRIPTION OF THE PREFERRED EMBODIMENT

Figure 1:
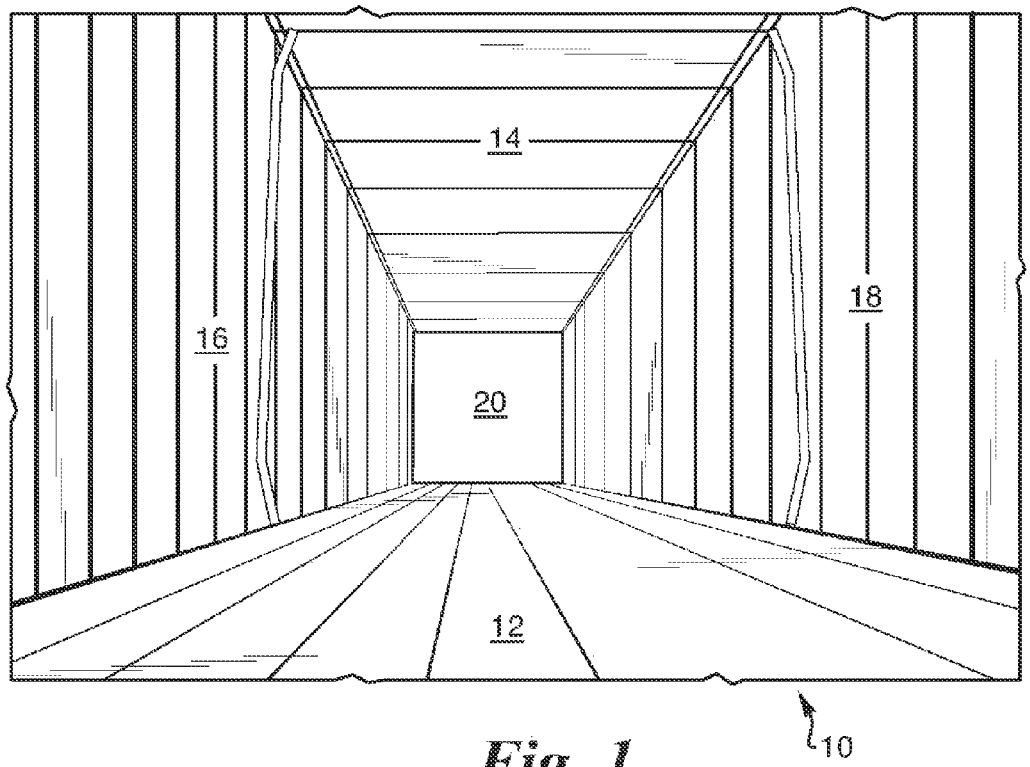
FIG. 1 shows a curtain sider trailer in an embodiment of the present invention.

The following discussion is presented to enable a person skilled in the art to make and use the present teachings. Various modifications to the illustrated embodiments will be readily apparent to those skilled in the art, and the generic principles herein may be applied to other embodiments and applications without departing from the present teachings. Thus, the present teachings are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of the present teachings. Skilled artisans will recognize the examples provided herein have many useful alternatives and fall within the scope of the present teachings. While embodiments of the invention discussed below are discussed in detail with respect to the shipping of vehicles such as ATVs and golf carts, it is fully contemplated the invention could be extended to most any vehicle or commodity without departing from the spirit of the invention.

Figure 2:
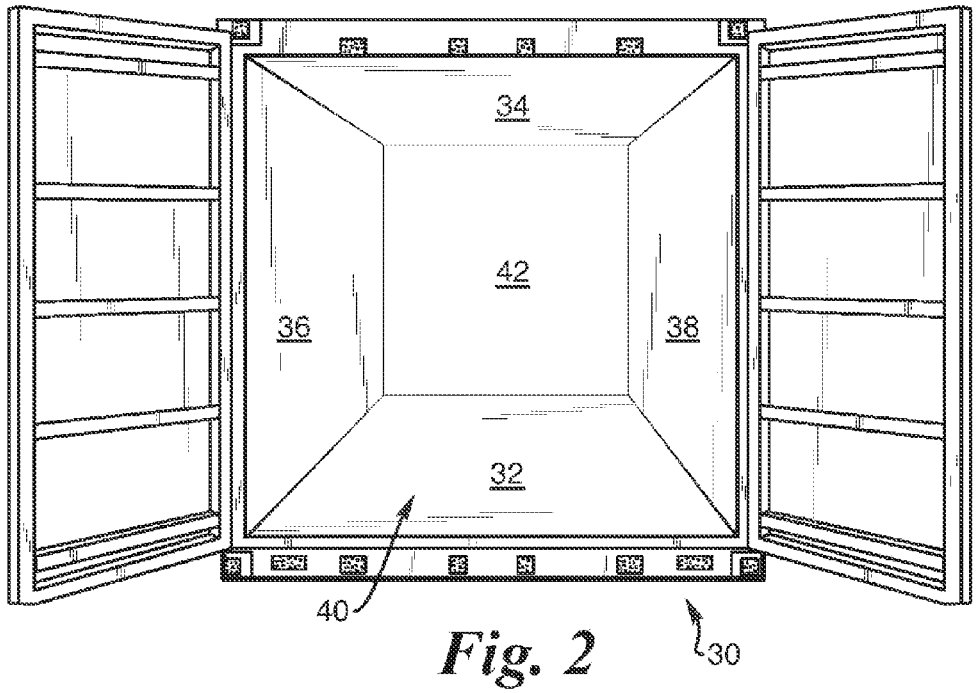
FIG. 2 shows a shipping container in an embodiment of the present invention.

With reference to FIGS. 1 and 2, environments for application of embodiments of the present invention are shown. FIG. 1 shows a curtain sider trailer 10 having a deck 12, ceiling 14, a first curtain side 16, a second curtain side 18, and a front end 20. As discussed above, curtain sider trailer 10 could be utilized for land transport of commodities, such as ATVs and golf carts (vehicles), transported by tractor trailer trucks. Implementation of a decking system for a curtain sider trailer will be discussed in more detail below.

FIG. 2 shows a shipping container 30 having a base 32, ceiling 34, side walls 36 and 38, and container openings 40 and 42. Shipping container 30 can be used to ship commodities, such as vehicles, via land, air, or sea. Shipping container 30 can be carried on tractor trailer trucks, ships, or planes. Implementation of a decking system for a shipping container will be discussed in more detail below.

Figure 3:
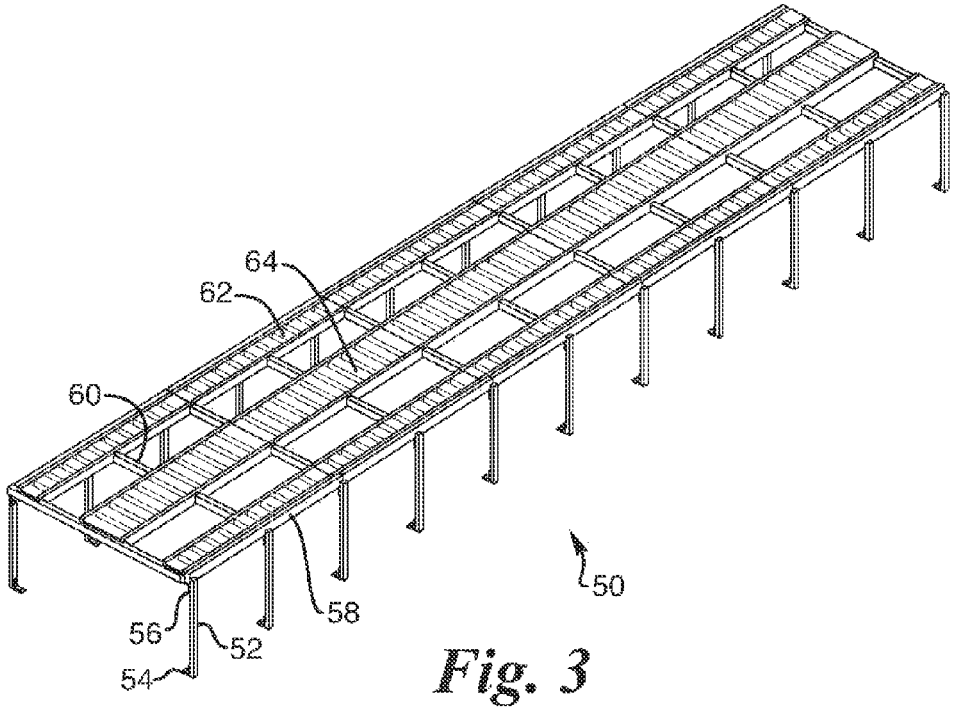
FIG. 3 shows all isometric view of a decking system for a shipping container in an embodiment of the present invention.

With reference to FIG. 3, an isometric view of a decking system for a shipping container in an embodiment of the present invention is shown. Shipping container decking system 50 can have a rail leg 52 having a floor coupler 54 and a decking coupler 56, rail 58, cross-rail 60, one-wheel deck panel 62, and two-wheel deck panel 64. Overall decking system 50 is approximately 39'6" long, 90" wide, and 53" high. Thus decking system 50 could fit well within a 53', 48', 45', or 40' shipping container without modification. Further, with modification, decking system 50 could be placed within a 20' shipping container by simply reducing decking system 50 to half its size as will become more readily apparent with further discussion of embodiments of the present invention. While decking system 50 is referenced above with specific measurements, it is fully contemplated decking system 50 could have most any, realistic, measurements to fit most any shipping container without departing from the spirit of the invention.

Figure 4:
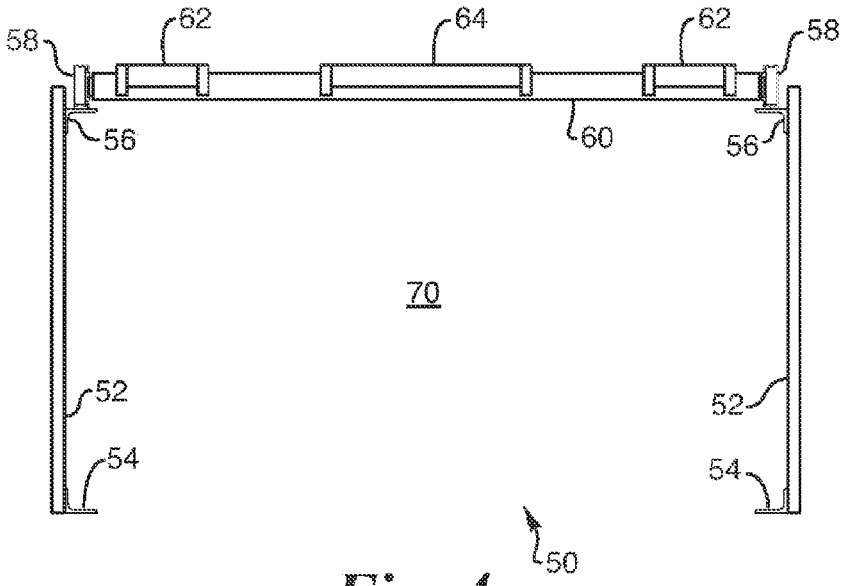
FIG. 4 shows a front or rear end view of a decking system for a shipping container in an embodiment of the present invention.

With reference to FIG. 4, a front or rear end view of a decking system for a shipping container in an embodiment of the present invention is shown. Decking system 50 can be made from an aluminum-nickel-titanium alloy known in the art as aluminum-6005 T5. However, most any material of necessary strength could be used without departing from the spirit of the invention. Rail legs 52 support decking system 50 above base 32. Rail leg 52 has a height of 52.37" to lift decking system 50 off of base 32 to allow vehicles to be parked or stowed below decking system 50 in the area marked as 70. Thus decking system 50 can have vehicles parked on decking system 50 and below decking system 50 thus filling up container 30.

Rail legs 52 can have floor couplers 54 to secure rail legs 52 to base 32. This could be performed by simply drilling holes into base 32 and securing floor couplers 54 to base 32 with bolts or screws or most any other fastening device. Floor couplers 54 are also secured to rail legs 52 as well. Floor couplers 54 and rail legs 52 can be one integral part, welded together, or can even be attached with a fastening device. Floor couplers provide vertical stability for rail legs 52 so rail legs 52 do not fall over or collapse. At the top of rail legs 52 are decking couplers 56. Decking couplers 56 provide support for rail 58, cross-rail 60, one-wheel deck panel 62, and two-wheel deck panel 64 and eventually vehicles 200. As with floor couplers 54, decking couplers 56 can be integral with rail legs 52, welded to rail legs 52, or attached with a fastening device.

Figure 5:
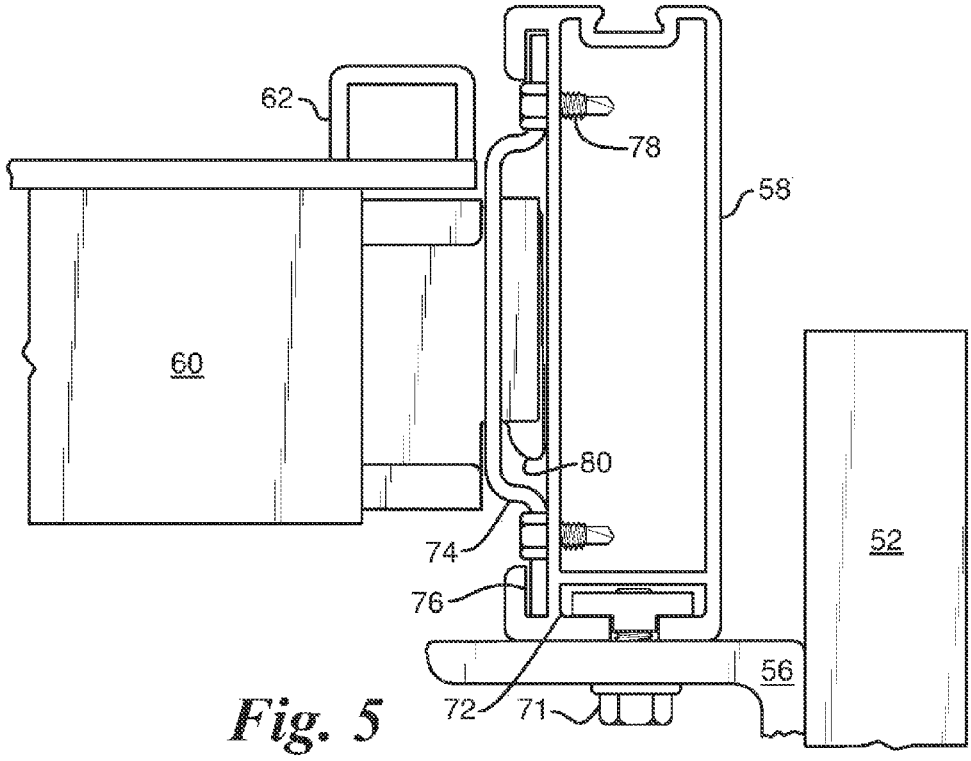
FIG. 5 shows a front view of connection between decking couplers, rails, and cross rails in an embodiment of the present invention.

With reference to FIG. 5, a front view of connection between decking couplers, rails, and cross rails in an embodiment of the present invention is shown. From this view, decking coupler 56 is coupled to rail 58 with a nut and bolt assembly 71. During installation of decking system 50, bolts are placed through apertures in decking coupler 56. Rail 58 is then placed adjacent to decking coupler 56 so the bolt head of bolt assembly 71 is captured or slid into rail slot 72. When the bolt heads are within rail slot 72, rail 58 is slid along decking coupler 56 until rail 58 is in place. When in place, a nut is placed on screw threading of bolt assembly 71 and then tightened into place thus securing rail 58 to decking coupler 56. This process is repeated for each decking coupler 56 and rail 58. Decking couplers 56 could be spaced approximately 47.75" apart to provide optimal strength and stability for vehicles 200 to be carried by decking system 50. It is fully contemplated rail legs 52 and decking couplers 56 could be spaced most any distance apart without departing from the spirit of the invention.

Figure 6:
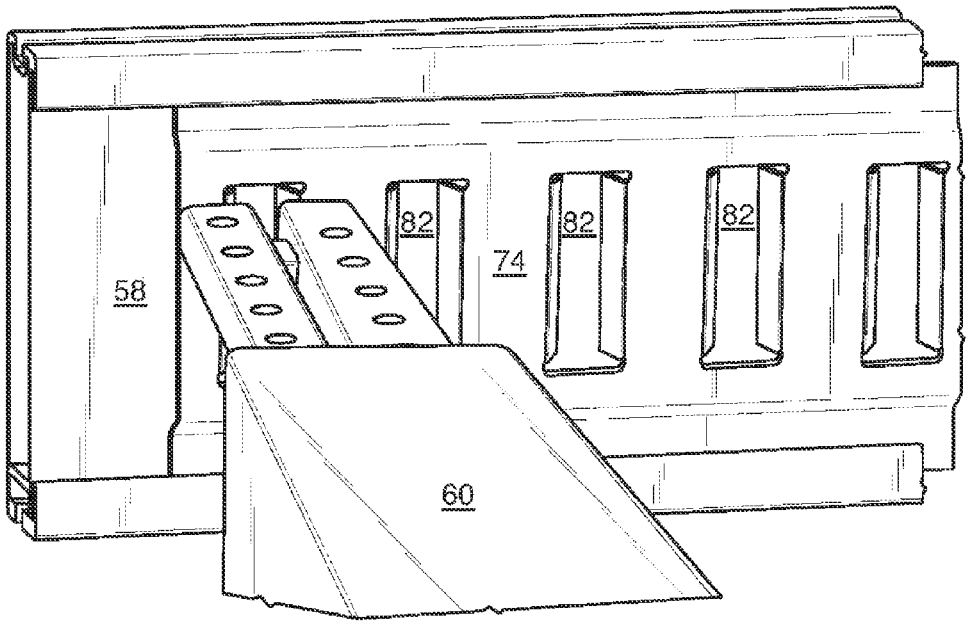
FIG. 6 shows a side view of a connection between rails and cross rails in an embodiment of the present invention.

With reference to FIG. 6, a side view of a connection between rails and cross rails in an embodiment of the present invention is shown. During installation of decking system 50, a ladder slat 74 is slid down slat slot 76 (FIG. 5) and held in place with attachment mechanisms, such as screws 78. Ladder slats 74 are used to support cross rails 60. Claw like catches 80 on the ends of cross rails 60 are placed into slots 82 located on ladder slat 74. A four sided stable structure is now created consisting of base 32, rail legs 52, and cross rails 60. Cross rails 60 are spaced every 47.75" to provide adequate support for decking system 50.

Figure 7:
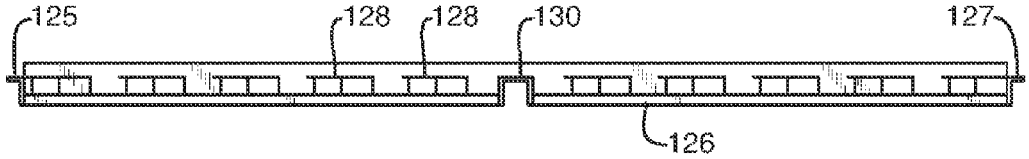
FIG. 7 shows a side view of a deck panel in an embodiment of the present invention.
Figure 8:
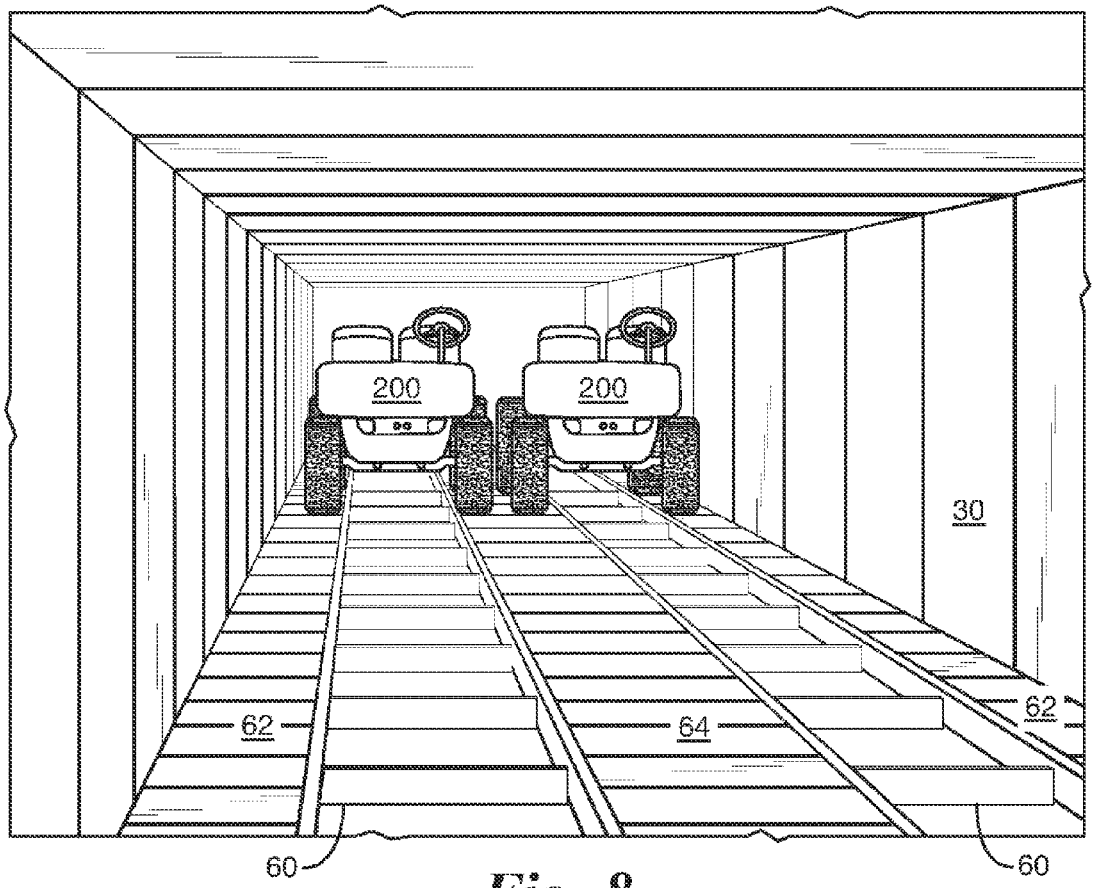
FIG. 8 shows a front view of a decking system with loaded ATVs in an embodiment of the present invention.

With reference to FIG. 7, a side view of a deck panel in an embodiment of the present invention is shown. A one wheel deck panel 62 is shown in FIG. 7, however, for purposes of this discussion a one wheel deck panel 62 and a two wheel deck panel 64 are essentially equivalent except for two wheel deck panel 64 is approximately twice as wide as one wheel deck panel 62 to provide support for two wheels instead of one as shown in FIG. 8. Deck panels 62 and 64 can be made of Welded aluminum-6061, however, deck panels 62 and 64 can be made of most any resilient material without departing from the spirit of the invention.

Each of deck panels 62 and 64 has a side rail 126, which may be extruded bars of I cross-section or, alternatively, can be extruded tubes of rectangular cross-section. Angle bars 125 and 127 are welded to the opposed ends of each of panels 62 and 64 for engaging cross rails 60. Extending between rails 125 and 127 and welded thereto is aluminum decking members 128. Without limitation, each of decking members 128 may be approximately 9" in width with adjacent decking members 128 spaced apart by about 3" along the length of rails 126. By spacing decking members 128 in the manner described, the overall weight of each decking system is reduced without compromise of its structural integrity and load bearing ability for the load contemplated.

Transversely extending channel 130 defines a notch inset into rails 126 at their approximate midsections to allow them to engage cross rails 60 at a location to prevent shifting of deck panels 62 and 64 due to any sudden acceleration or deceleration during shipping. Once deck panels 62 and 64 are installed so as to run the full length of the shipping container 30, ATVs 200 may now be loaded (FIG. 8). To facilitate the loading operation, the system of the present invention includes a ramp assembly used to allow ATVs 200 to be driven from ground level and up a ramp to either the floor level of the trailer or to the elevated deck. A suitable ramp for placing ATVs 200 on decking system 50 can be found in U.S. Pat. No. 6,524,055, issued to Overbye, titled Semi-Trailer Loading Ramp for Transporting ATVs herein incorporated by reference in its entirety.

Figure 9:
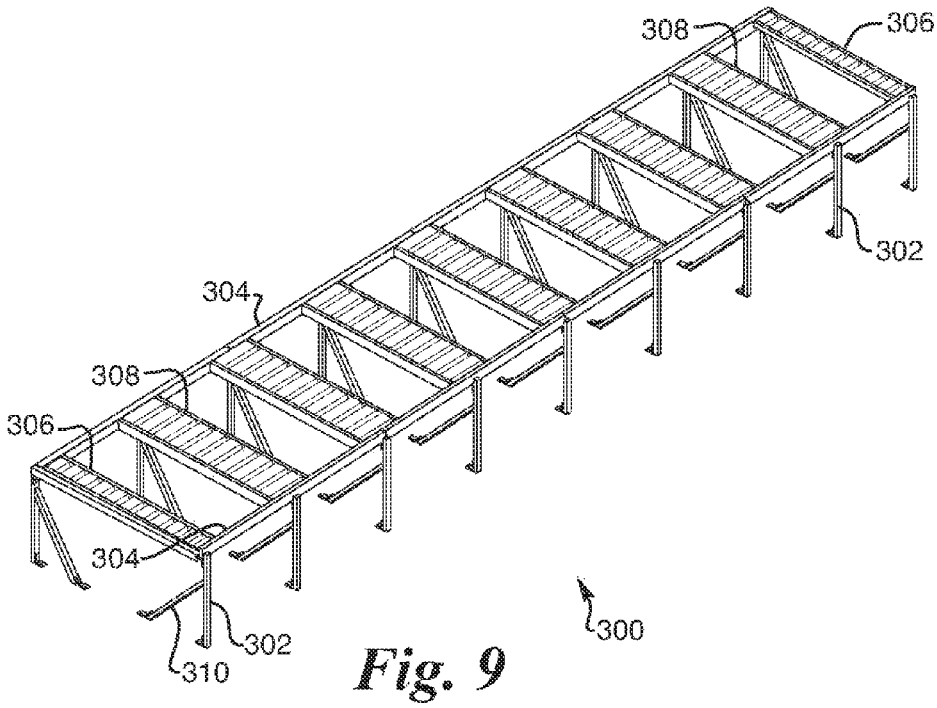
FIG. 9 shows an isometric view of a decking system for a curtain sider trailer in an embodiment of the present invention.

With reference to FIG. 9, an isometric view of a decking system for a curtain sider trailer in an embodiment of the present invention is shown. Similar to decking system 50, decking system 300 can be used with curtain sider trailer 10 as discussed above. Decking system 300 can have rail legs 302 supported by angled support members 310. Rail legs 302 can be connected to rails 304 in a manner similar to the discussion above. Rails 304 have, located between rails 304, one wheel 306 and two wheel deck panels 308 replacing cross rails 60 in the embodiment of decking system 50. Deck panels 306 and 308 could be secured directly to rails 304 to prevent movement of deck panels 306 or 308 during transportation. During loading of sider trailer 10 with vehicles 200, a ramp system as discussed above would be placed at the side of trailer 10 where vehicles 200 could be loaded. This could be done by loading a bottom vehicle first and then loading a top vehicle or vise versa. In this embodiment, vehicles 200 would be transported perpendicular to the length of trailer 10 in contrast to decking system 50. Nevertheless, no modification of any parts of decking system 50 is required. Decking system 300 could be implemented using elements of decking system 50. Thus, only one decking system could be manufactured and sold regardless of the environment it would be used within.

Thus, embodiments of the MODULAR VEHICLE TRANSPORT are disclosed. One skilled in the art will appreciate the present teachings can be practiced with embodiments other than those disclosed. The disclosed embodiments are presented for purposes of illustration and not limitation, and the present teachings are limited only by the claims follow.

What is claimed is:

1. A decking system for a transport vehicle, comprising:

(a) a plurality of deck panels operably coupled to and supported by edge rails extending parallel to the deck panels; and (b) a plurality of rail legs coupled to the edge rails at one end of the rail legs and extending the edge rails and deck panels up off of a base, the base being coupled to the rail legs at a second end of the rail legs; and (c) a plurality of cross rails positioned perpendicular to the plurality of deck panels and edge rails, the cross rails being coupled to the edge rails and supporting angle bars welded to the deck panels.

2. The decking system of claim 1, further comprising a plurality of angled support members coupled to the base and to the rail legs.

3. The decking system of claim 1, further comprising a floor couplers attached to the rail legs for providing attachment to the base.

4. The decking system of claim 1, further comprising a decking couplers attached to the rail legs proximate the one end for providing attachment to the edge rails.

5. The decking system of claim 1, further comprising a ladder slat coupled to the edge rails and having slots to receive cross rails.

6. A decking system as in claim 1 wherein said rail legs each have a floor coupler at said second end and a decking coupler at said one end; the floor coupler capable of being coupled to the base where the base forms a part of a shipping container; said edge rails coupled to the decking coupler;

a first cross rail coupled to the edge rails, the first one of said plurality of cross rails being perpendicular to the edge rails; and said deck panels being supported by the first cross rail and by a second one of said plurality of cross rails coupled to the edge rails.

7. The decking system of claim 6, wherein the decking system is made of an aluminum alloy.

8. A decking system as in claim 1 wherein the plurality of deck panels include:

a left deck panel, a center deck panel, and a right deck panel;

a first of the plurality of cross rails supporting a front of the left, the center, and the right deck panels;

a second of the plurality of cross rails supporting a middle of the left, the center, and the right deck panels;

a third of the plurality of cross rails supporting a rear of the left, the center, and the right deck panels;

a first of said edge rails coupled to a left side of the first, the second, and the third cross rails;

a second of said edge rails coupled to a right side of the first, the second, and the third cross rails; and one of said rail legs being coupled individually to a front, a middle and a rear of the first and second edge rails.

9. The decking system of claim 8, wherein said angle bars are individually attached to the left, center and right deck panels on opposed ends thereof, the angle bars resting upon the first and third cross rails for support of the deck panels.

10. The decking system of claim 9, further comprising a channel located in a midportion of the deck panels for accepting the second cross rail within the channel.

11. The decking system of claim 8, further comprising a rail slot on the edge rails for coupling the edge rails to the rail legs.

12. The decking system of claim 1 wherein the base is a floor of a rail car.

13. The decking system of claim 1 wherein the base is a floor of a semitrailer.

14. The decking system of claim 1 wherein the base is a floor of a cargo shipping container.

15. The decking system as in claim 8 wherein the left deck panel and right deck panel are rectangular and about one-half of a width dimension of the center panel which is also rectangular.

* * * * *